US007800635B2

(12) United States Patent
Kim

(10) Patent No.: US 7,800,635 B2
(45) Date of Patent: Sep. 21, 2010

(54) METHOD FOR DISPLAYING IMAGE IN WIRELESS TERMINAL

(75) Inventor: Jae-Hyoun Kim, Daegu (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 148 days.

(21) Appl. No.: 11/441,052

(22) Filed: May 26, 2006

(65) Prior Publication Data

US 2007/0195114 A1 Aug. 23, 2007

(30) Foreign Application Priority Data

Feb. 17, 2006 (KR) ..... 10-2006-0015813

(51) Int. Cl.
*G09G 5/00* (2006.01)

(52) U.S. Cl. ..... 345/659; 345/502; 345/538; 345/619; 345/660

(58) Field of Classification Search ..... 345/649, 345/656, 659, 530–541, 619, 546, 547, 571, 345/660; 455/556, 575.3; 715/788
See application file for complete search history.

(56) References Cited

U.S. PATENT DOCUMENTS 5,434,964 A * 7/1995 Moss et al. ..... 715/788
5,949,408 A * 9/1999 Kang et al. ..... 345/649
6,011,585 A * 1/2000 Anderson ..... 345/656
6,639,603 B1 * 10/2003 Ishii ..... 345/659
6,809,737 B1 10/2004 Lee et al.
2001/0030656 A1 * 10/2001 Chan ..... 345/659
2003/0013483 A1 * 1/2003 Ausems et al. ..... 455/556
2003/0095124 A1 * 5/2003 Tjandrasuwita ..... 345/538
2003/0222853 A1 * 12/2003 Kim ..... 345/169
2003/0222889 A1 * 12/2003 Parulski et al. ..... 345/619
2004/0223004 A1 * 11/2004 Lincke et al. ..... 345/649
2004/0239792 A1 * 12/2004 Shibutani et al. ..... 348/333.12
2004/0247178 A1 * 12/2004 Reese ..... 382/162
2005/0143124 A1 6/2005 Kennedy et al.
2005/0184993 A1 * 8/2005 Ludwin et al. ..... 345/502
2006/0187239 A1 * 8/2006 Clark-Lindh ..... 345/659
2006/0223595 A1 * 10/2006 Kim ..... 455/575.3
2006/0238541 A1 * 10/2006 Toni ..... 345/531

FOREIGN PATENT DOCUMENTS

EP 0 598 547 A2 11/1993

* cited by examiner

*Primary Examiner*—Kimbinh T Nguyen
(74) *Attorney, Agent, or Firm*—Roylance, Abrams, Berdo & Goodman, L.L.P.

(57) ABSTRACT

A method for displaying an image in a wireless terminal including at least two screen modes is provided, in which a display buffer existing in one Device Context (DC) is formed, capable of recording a corresponding image to be displayed according to screen sizes in the at least two screen modes, and recording the corresponding image to be displayed according to a screen size of a corresponding screen mode in the at least two screen modes through the display buffer existing in the DC, and outputting the corresponding image to a screen in the corresponding screen mode.

20 Claims, 6 Drawing Sheets

(a)

(b)

METHOD FOR DISPLAYING IMAGE IN WIRELESS TERMINAL

CROSS-REFERENCE TO RELATED APPLICATIONS

This application claims the benefit under 35 U.S.C. §119 (a) of a Korean Patent Application filed in the Korean Intellectual Property Office on Feb. 17, 2006 and assigned Ser. No. 2006-15813, the entire disclosure of which is hereby incorporated by reference.

BACKGROUND OF THE INVENTION

1. Field of the Invention

The present invention relates to a method for displaying images in a wireless terminal. More particularly, the present invention relates to a method for displaying images in a wireless terminal, in which a corresponding image is recorded in the screen size of a corresponding screen mode by means of one Device Context (DC) in the wireless terminal, and is outputted.

2. Description of the Related Art

In a typical wireless terminal, a DC is formed in a memory in order to display images on a Liquid Crystal Display (LCD). The wireless terminal records images, which are to be output to the LCD, in the DC, and then outputs the images recorded in the corresponding DC to the LCD. The DC transfers information of an output unit, which corresponds to a data structure including all information necessary for output. The information necessary for output includes a type of font, color and thickness of a line, fill pattern, color, output method, and the like. The DC includes a virtual display buffer, and images recorded in the virtual display buffer are finally transmitted to a LCD driver and thus output to the LCD. The virtual display buffer has a size of X*Y* color bit.

In a current wireless terminal for supporting a landscape screen mode and a portrait screen mode according to positions of its folder, the wireless terminal uses two DCs for the landscape screen mode and the portrait screen mode.

For example, when the portrait screen mode has a screen size of 176×220, the wireless terminal has one DC having a size of 176×220. When the landscape screen mode has a screen size of 220×176, the wireless terminal has another DC having a size of 220×176. That is, the wireless terminal has the total two DCs. As described above, the wireless terminal has the DCs according to the landscape screen mode and the portrait screen mode, so that the wireless terminal can display data suitable for each screen mode and continue to display the data. Accordingly, a quick screen change is possible.

However, since the wireless terminal separately maintains the DCs corresponding to the landscape screen mode and the portrait screen mode, there is no image continuity between the DCs, and functions for writing images must be separately created for each DC. Therefore, the amount of codes may increase.

For example, in a state in which five menu lists are output in a portrait screen mode, when the portrait screen mode is switched into a landscape screen mode in order to select the third menu list from the five menu lists, the output state in the portrait screen mode must be maintained even when the portrait screen mode is switched into the landscape screen mode. However, if DCs are separately operated, corresponding information must be configured in a DC for the portrait screen mode before being output to a LCD.

SUMMARY OF THE INVENTION

An aspect of exemplary embodiments of the present invention is to address at least the above problems and/or disadvantages and to provide at least the advantages described below. Accordingly, an aspect of exemplary embodiments of the present invention is to provide a method for displaying images in a wireless terminal, in which a corresponding image is recorded in the screen size of a corresponding screen mode by means of one Device Context (DC) in the wireless terminal and outputted.

In order to accomplish the aforementioned object, according to one aspect of exemplary embodiments of the present, there is provided a method for displaying an image in a wireless terminal including at least two screen modes, in which a display buffer existing in one Device Context (DC) is formed, capable of recording a corresponding image to be displayed according to screen sizes in at least two screen modes. The corresponding image to be displayed according to a screen size of a corresponding screen mode is recorded in the at least two screen modes through the display buffer existing in the DC, and the corresponding image is output to a screen in the corresponding screen mode.

In order to accomplish the aforementioned object, according to another aspect of exemplary embodiments the present, there is provided a method for displaying an image in a wireless terminal including a first and a second screen modes, in which a display buffer existing in one Device Context (DC) is formed, capable of recording a corresponding image to be displayed according to screen sizes in the first and the second screen modes. Whether the wireless terminal is in the first screen mode or the second screen mode is determined. When the wireless terminal is in the first screen mode, a corresponding image is recorded in both a first area, which are shared by the screen sizes in the first and the second screen modes, and a third area for the screen size in the first screen mode in the display buffer existing in the DC, and the corresponding image is output to a screen in the first screen mode. When the wireless terminal is in the second screen mode, a corresponding image is recorded in both the first area, which are shared by the screen sizes in the first and the second screen modes, and a second area for the screen size in the second screen mode in the display buffer existing in the DC, and the corresponding image is output to a screen in the second screen mode.

In order to accomplish the aforementioned object, according to a further aspect of exemplary embodiments of the present, there is provided a method for displaying an image in a wireless terminal including a first and a second screen modes, in which a display buffer existing in one Device Context (DC) is formed, capable of recording a corresponding image to be displayed according to screen sizes in the first and the second screen modes. Whether the wireless terminal is in the first screen mode or the second screen mode. When the wireless terminal is in the first screen mode, a corresponding image is recorded in both a first area, which are shared by the screen sizes in the first and the second screen modes, and a second area, which is logically added to a predetermined location of the first area in order to correspond to the screen size in the second screen mode, in the display buffer existing in the DC, and the corresponding image is output to a screen in the first screen mode. When the wireless terminal is in the second screen mode, a corresponding image is recorded in both the first area, which are shared by the screen sizes in the first and the second screen modes, and the second area, which is logically added to the predetermined location of the first area in order to correspond to the screen size in the second screen mode, in the display buffer existing in the DC, and the corresponding image is output to a screen in the second screen mode.

BRIEF DESCRIPTION OF THE DRAWINGS

The above and other objects, features and advantages of certain exemplary embodiments of the present invention will be more apparent from the following detailed description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

In an exemplary embodiment of the present invention, a Device Context (DC) represents a virtual display buffer therein.

Figure 1:
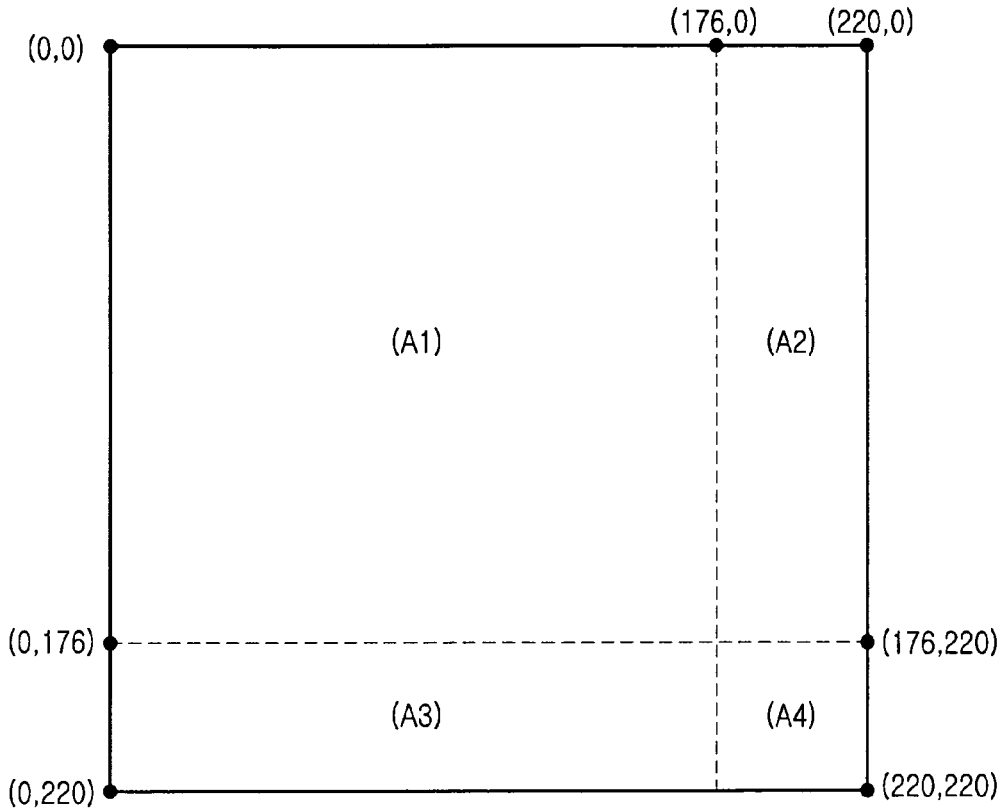
FIG. 1 is a block diagram illustrating a display buffer of a DC according to an exemplary embodiment of the present invention.

FIG. 1 is a block diagram illustrating a display buffer of a DC according to a first embodiment of the present invention. According to an exemplary embodiment of the present invention, in a wireless terminal provided with a folder used for switching into a portrait screen mode or a landscape screen mode, a description will be given with assumption that the portrait screen mode has a screen size of 176×220 and the landscape screen mode has a screen size of 220×176. When the portrait screen mode has a screen size of 176×220 in the wireless terminal, if the wireless terminal is switched into the landscape screen mode, the screen size of the wireless terminal is switched into of 220×176. That is, if the widthwise size 176 of the screen size in the portrait screen mode becomes the lengthwise size 176 of the screen size in the landscape screen mode, the lengthwise size 200 of the screen size in the portrait screen mode becomes the widthwise 200 of the screen size in the landscape screen mode.

Referring to FIG. 1, the display buffer of the DC has a size of 220×220 which can include the screen size 176×220 in the portrait screen mode and the screen size 220×176 in the landscape screen mode. The display buffer of the DC having a size of 220×220 includes a first area A1 having a size of 176×176, a second area A2 having a size of 44×176, a third area A3 having a size of 176×44, and a remaining area A4 having a size of 44×44. The first area A1 may be used for the screen size both in the portrait screen mode and in the landscape screen mode. The second area A2 is used only for the screen size of the landscape screen mode, and the third area A3 is used only for the screen size of the portrait screen mode. The first area A1 and the third area A3 corresponds to the display buffer of the DC for recording a corresponding image to be output to the screen size in the portrait screen mode, and the first area A1 and the second area A2 corresponds to the display buffer of the DC for recording a corresponding image to be output to the screen size in the landscape screen mode.

Hereinafter, an operation for recording and outputting images through the display buffer of one DC as constructed in FIG. 1 will be described in detail with reference to FIG. 2.

Figure 2:
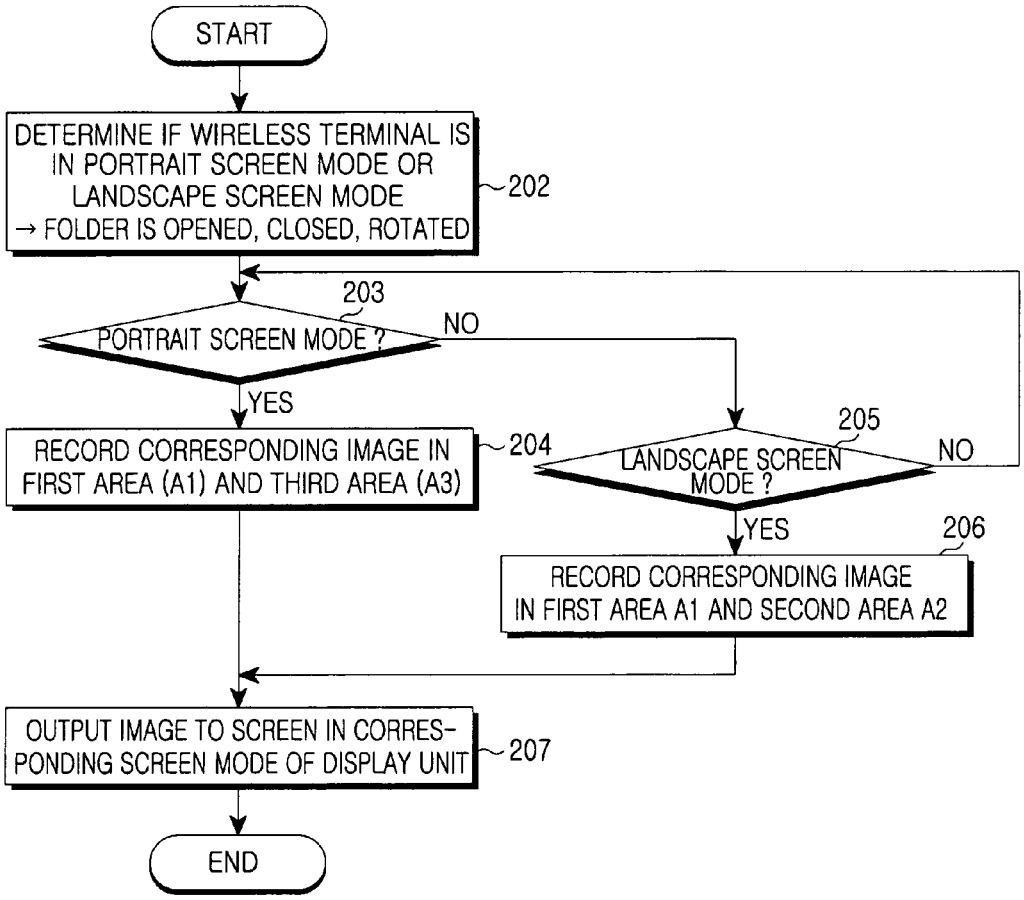
FIG. 2 is a flow diagram illustrating a process for recording and outputting images through a display buffer of a DC according to an exemplary embodiment of the present invention.

FIG. 2 is a flow diagram illustrating a process for recording and outputting images through the display buffer of the DC according to an exemplary embodiment of the present invention.

Referring to FIG. 2, in step 202, a controller for controlling the general operation of the wireless terminal determines if the wireless terminal is in a portrait screen mode or a landscape screen mode. If the wireless terminal has a folder which can be rotated oppositely to its body, the controller determines if the display unit of the wireless terminal has been switched into the portrait screen mode through rotation of the folder far away from the body, or if the display unit of the wireless terminal has been switched into the landscape screen mode through further rotation of the folder in a state of being away from the body.

Further, if the wireless terminal has a folder which is opened in a different direction and in opposition to the body, the controller determines if the folder in a closed state is opened in a predetermined direction, for example upward, and in opposition to the body and the display unit of the wireless terminal is switched into the portrait screen mode, or if the folder in a closed state is opened in a predetermined direction, for example rightward, and in opposition to the body and the display unit of the wireless terminal is switched into the landscape screen mode.

If it is determined that the wireless terminal has been switched into the portrait screen mode through step 202, the controller detects the switching into the portrait screen mode in step 203. In step 204, the controller records a corresponding image to be output to the screen size of the portrait screen mode while increasing a column address value from leftward to rightward and increasing a line address value from upward to downward in the first area A1 and the third area A3 of the display buffer of the DC as illustrated in FIG. 1. That is, when it is detected that the wireless terminal is switched into the portrait screen mode through rotation of the folder of the wireless terminal far away from the body or that the folder in a closed state is opened upward for the switching into the portrait screen mode, the controller performs the corresponding image recording process of step 204. Accordingly, it is possible to reduce consumption of time required for new updates to the screen in the portrait screen mode.

However, if it is determined that the wireless terminal has been switched into the landscape screen mode through step 202, the controller detects the switching into the landscape screen mode in step 205. In step 206, the controller records a corresponding image to be output to the screen size in the landscape screen mode while increasing the column address value from leftward to rightward and increasing the line address value from upward to downward in the first area Al and the second area A2 of the display buffer of the DC as illustrated in FIG. 1. That is, when it is detected that the wireless terminal is switched into the landscape screen mode through rotation of the folder in state of being away from the body of the wireless terminal or that the folder in a closed state is opened rightward for the switching into the landscape screen mode, the controller performs the corresponding image recording process of step 206. Accordingly, it is possible to reduce consumption of time required for new updates to the screen size of the landscape screen mode.

Either the corresponding image recorded in the first area A1 and the third area A3 of the display buffer of the DC in step 204 in order to be output to the screen size in the portrait screen mode, or the corresponding image recorded in the first area A1 and the second area A2 of the display buffer of the DC in step 206 in order to be output to the screen size in the landscape screen mode is stored in the memory of a display unit driver and output to the screen in a corresponding screen mode of the display unit, in step 207.

Figure 3:
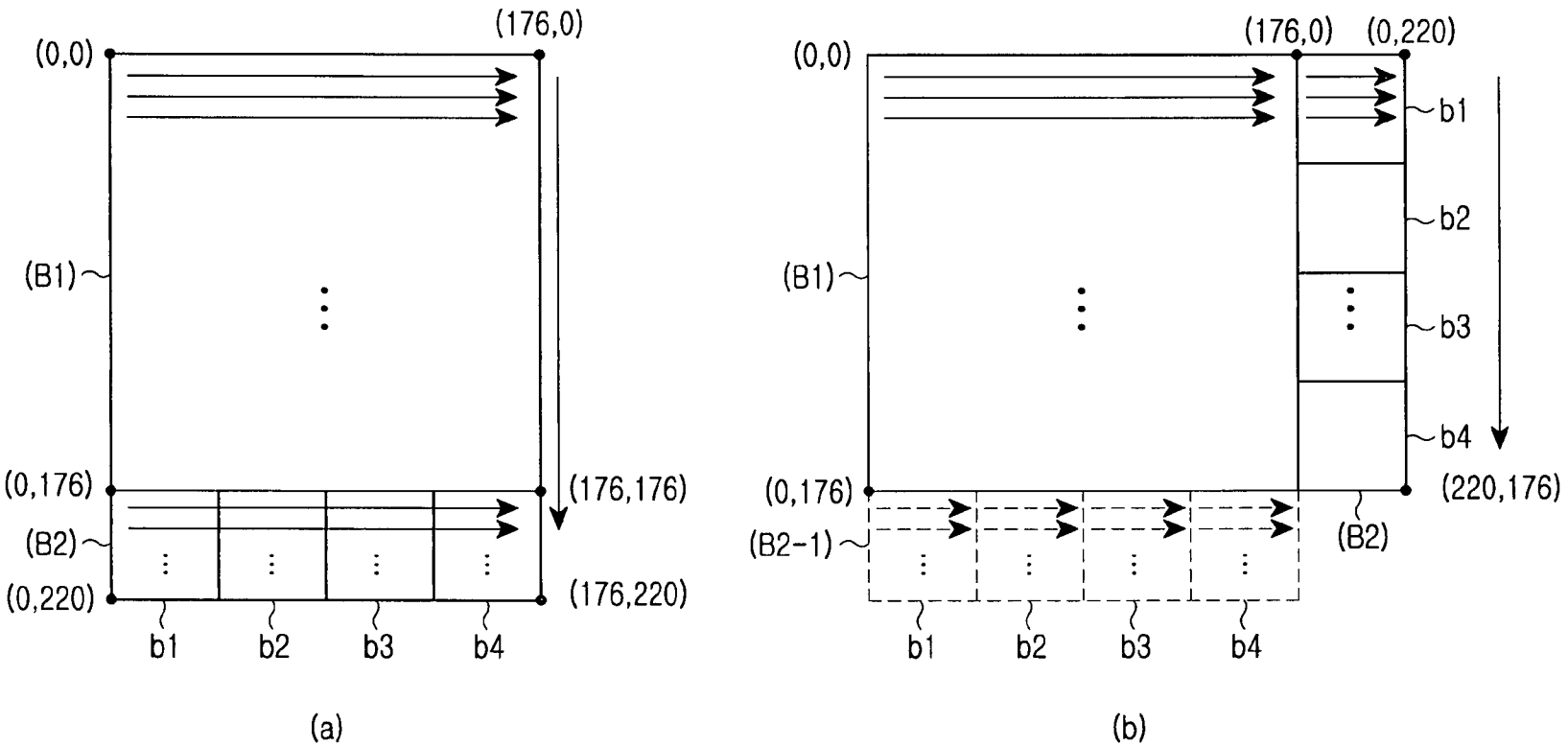
FIGS. 3*a* and 3*b* is a block diagram illustrating a display buffer of a DC according to an exemplary embodiment of the present invention.

FIG. 3 is a block diagram illustrating a display buffer of a DC according to an exemplary embodiment of the present invention. According to an exemplary embodiment of the present invention, in a wireless terminal provided with a folder used for switching into a portrait screen mode or a landscape screen mode, a description will be given assuming, for example, that the portrait screen mode has a screen size of 176×220 and the landscape screen mode has a screen size of 220×176. In an exemplary embodiment of the present invention, the display unit of the wireless terminal operates with a fixed screen size of 5:4.

Referring to FIGS. 3*a* and 3*b*, the display buffer of the DC includes a first area B1 having a size of 176×176 and a second area B2 having a size of 176×44. The first area B1 may be used for the screen size both in the portrait screen mode having a screen size of 176×220 and in the landscape screen mode having a screen size of 220×176. The second area B2 is logically added to a predetermined position of the first area B1 according to corresponding screen modes to constitute the display buffer of the DC in the corresponding screen mode. The second area B2 is divided into four areas b1 to b4, each of which has a size of 44×44, according to the condition that the display unit of the wireless terminal has a fixed screen size of 5:4. The four areas are formed by a segment/bank.

FIG. 3*a* illustrates the display buffer of the DC formed by logically adding the second area B2 to the physical lower side of the first area B1 for the screen size in the portrait screen mode. FIG. 3*b* illustrates the display buffer of the DC formed by logically adding the second area B2 to the right side of the first area B1 for the screen size in the landscape screen mode.

Hereinafter, an operation for recording and outputting images through the display buffer of one DC as constructed in FIG. 3 will be described in detail with reference to FIG. 4.

Figure 4:
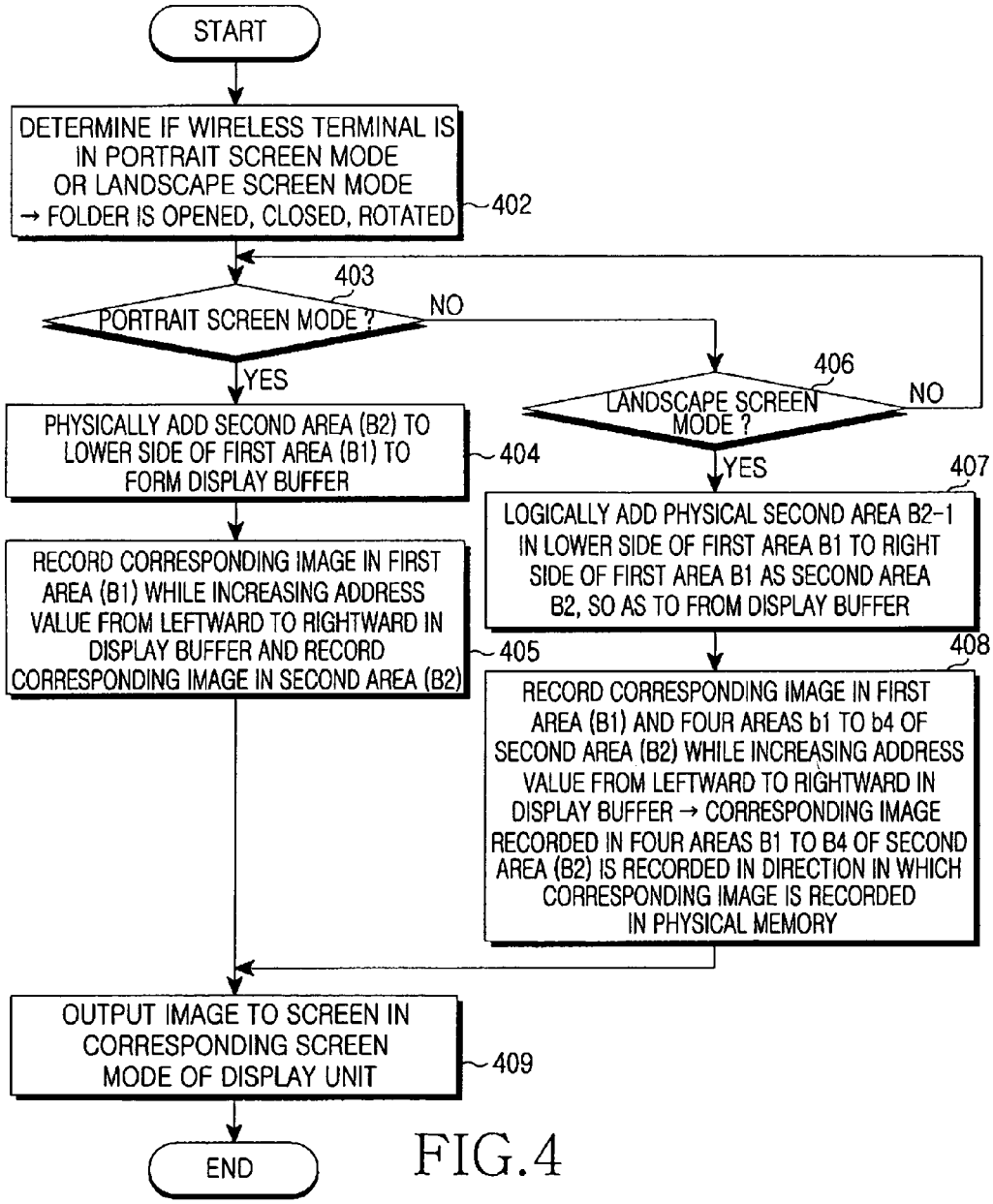
FIG. 4 is a flow diagram illustrating a process for recording and outputting images through a display buffer of a DC according to an exemplary embodiment of the present invention.

FIG. 4 is a flow diagram illustrating a process for recording and outputting images through the display buffer of the DC according to an exemplary embodiment of the present invention.

Referring to FIG. 4, in step 402, a controller for controlling the general operation of the wireless terminal determines if the wireless terminal is in a portrait screen mode or a landscape screen mode. If the wireless terminal has a folder which can be rotated oppositely to its body, the controller determines if the display unit of the wireless terminal has been switched into the portrait screen mode through rotation of the folder far away from the body, or if the display unit of the wireless terminal has been switched into the landscape screen mode through further rotation of the folder in a state of being away from the body.

Further, if the wireless terminal has a folder which is opened in a different direction and in opposition to the body, the controller determines if the folder in a closed state is opened in a predetermined direction, for example, upward, and in opposition to the body and the display unit of the wireless terminal is switched into the portrait screen mode, or if the folder in a closed state is opened in a predetermined direction, for example, rightward, and in opposition to the body and the display unit of the wireless terminal is switched into the landscape screen mode.

If it is determined that the wireless terminal has been switched into the portrait screen mode through step 402, the controller detects the switching into the portrait screen mode in step 403. In step 404, the controller logically adds the second area B2 to the lower side of the first area B1 as illustrated in FIG. 3*a*, thereby forming the display buffer of the DC for the screen size in the portrait screen mode. In step 405, the controller records a corresponding image from the start address value (0, 0) to the last address value (176, 176) of the first area B 1 while increasing a column address value from leftward to rightward and increasing a line address value from upward to downward in the display buffer of the DC formed by logically adding the second area B2 to the lower side of the first area B 1. If the corresponding image is completely recorded in the first area B1 in step 405, the controller records the corresponding image from the start address value (0, 176) to the last address value (176, 220) of the second area B2 while increasing the column address value from leftward to rightward and increasing the line address value from upward to downward. Accordingly, the controller controls the corresponding image, which is to be output to the screen size in the portrait screen mode, to be recorded.

Further, when it is detected that the wireless terminal is switched into the portrait screen mode through rotation of the folder of the wireless terminal far away from the body or that the folder in a closed state is opened upward for the switching into the portrait screen mode, the controller performs the corresponding image recording process through steps 404 and 405. Accordingly, it is possible to reduce consumption of time required for new updates to the screen size of the portrait screen mode.

However, if it is determined that the wireless terminal has been switched into the landscape screen mode through step 402, the controller detects the switching into the landscape screen mode in step 406. In step 407, the controller logically adds the second area B2 to the right side of the first area B1 as illustrated in FIG. 3*b*, thereby forming the display buffer of the DC for the screen size in the landscape screen mode.

In step 408, the controller records a corresponding image from the start address value (0, 0) of the first area B1 to the last address value (220, 176) of the second area B2 while increasing the column address value from leftward to rightward and increasing the line address value from upward to downward in the display buffer of the DC formed by logically adding the second area B2 to the right side of the first area B1.

Hereinafter, the corresponding image recording process performed in step 408 will be described in more detail. If the column address value increasing from leftward to rightward exceeds an address value (176, Y), the controller records pixels of the corresponding image in the corresponding line of a corresponding area from among the four areas b 1 to b4 of the second area B2 logically added to the right side of the first area B1. If the column address value exceeds an address value (220, Y), the controller records pixels of the corresponding image in both the corresponding line of the first area B1 and the second area B2 while increasing the line address value from upward to downward.

Herein, a direction in which the corresponding image is recorded in the second area B2 is computed and recorded in a direction actually recorded in a physical memory. In FIG. 3*b*, the second area (B2-1) represents a direction in which the corresponding image recorded in the second area B2 is actually recorded in the physical memory.

Further, when it is detected that the wireless terminal is switched into the landscape screen mode through rotation of the folder in a state of being away from the body of the wireless terminal or that the folder in a closed state is opened rightward for the switching into the landscape screen mode, the controller performs the corresponding image recording process through steps 407 and 408. Accordingly, it is possible to reduce consumption of time required for new updates to the screen size of the landscape screen mode.

Either the corresponding image recorded in the display buffer of the DC formed by logically adding the second area B2 to the lower side of the first area B1 in step 405 in order to be output to the screen size in the portrait screen mode, or the corresponding image recorded in the display buffer of the DC formed by logically adding the second area B2 to the right side of the first area B1 in step 408 in order to be output to the screen size in the landscape screen mode is stored in the memory of a display unit driver and output to the screen of a corresponding screen mode of the display unit, in step 409.

Figure 5:
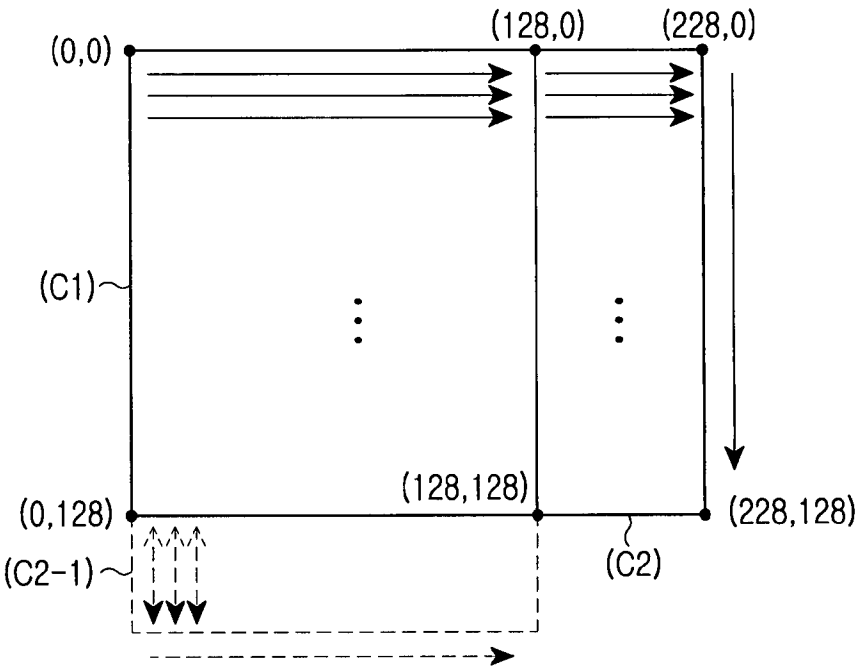
FIGS. 5*a* and 5*b* is a block diagram illustrating a display buffer of a DC according to an exemplary embodiment of the present invention.
Figure 5:
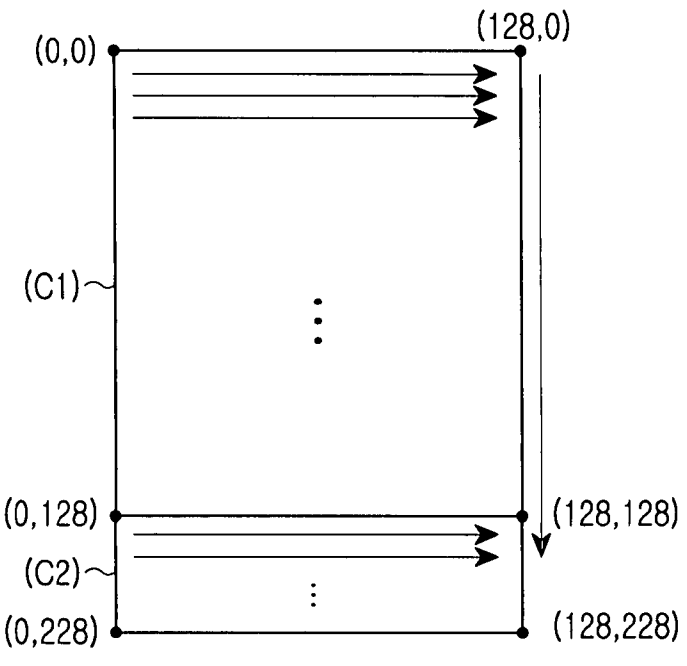

FIG. 5 is a block diagram illustrating a display buffer of a DC according to a third embodiment of the present invention, which exemplifies a display buffer of a DC when the aspect ratio of a wireless terminal is a fixed ratio.

According to an exemplary embodiment of the present invention, in the wireless terminal provided with a folder used for switching into a portrait screen mode or a landscape screen mode, a description will be given assuming, for example, that the aspect ratio of the wireless terminal is 16:9 in which the portrait screen mode has a screen size of 128×228 and the landscape screen mode has a screen size of 228×128.

Referring to FIGS. 5*a* and 5*b*, the virtual display buffer of the DC includes a first area C1 having a size of 128×128 and a second area C2 having a size of 128×100. The first area C1 may be used for the screen size both in the portrait screen mode having a screen size of 128×228 and in the landscape screen mode having a screen size of 228×128. The second area C2 is logically added to a predetermined position of the first area C1 according to corresponding screen modes to constitute the display buffer of the DC in the corresponding screen mode. The second area C2 has one area formed by a segment/bank.

FIG. 5*a* illustrates the display buffer of the DC formed by logically adding the second area C2 to the physical lower side of the first area C1 for the screen size in the portrait screen mode.

FIG. 5*b* illustrates the display buffer of the DC formed by logically adding the second area C2 to the right side of the first area C1 for the screen size in the landscape screen mode.

Hereinafter, an operation for recording and outputting images through the display buffer of one DC as constructed in FIG. 5 will be described in detail with reference to FIG. 6.

Figure 6:
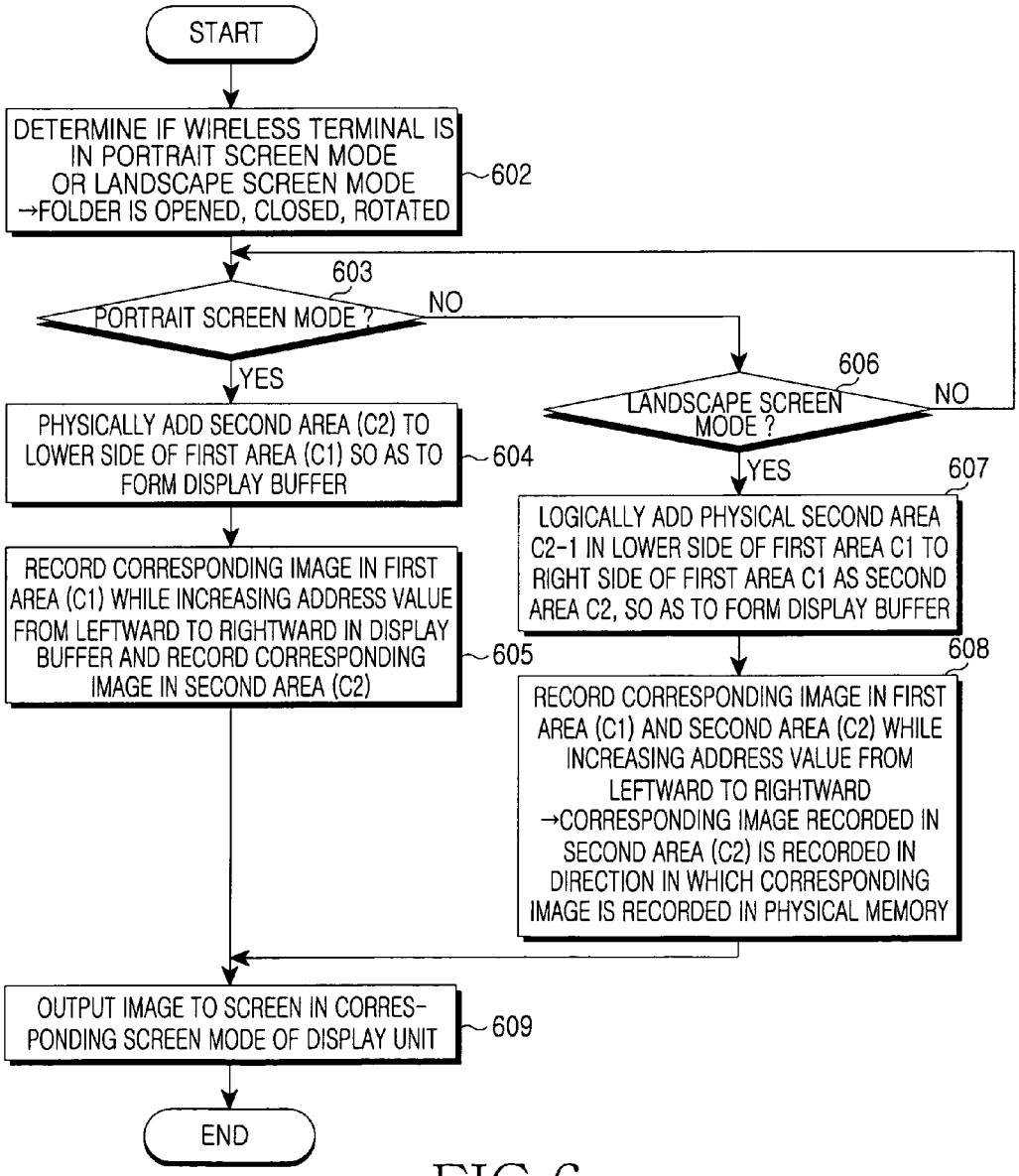
FIG. 6 is a flow diagram illustrating a process for recording and outputting images through a display buffer of a DC according to an exemplary embodiment of the present invention.

FIG. 6 is a flow diagram illustrating a process for recording and outputting images through the display buffer of the DC according to an exemplary embodiment of the present invention.

Referring to FIG. 6, in step 602, a controller for controlling the general operation of the wireless terminal determines if the wireless terminal is in a portrait screen mode or a landscape screen mode. If the wireless terminal has a folder which can be rotated oppositely to its body, the controller determines if the display unit of the wireless terminal has been switched into the portrait screen mode through rotation of the folder far away from the body, or if the display unit of the wireless terminal has been switched into the landscape screen mode through further rotation of the folder in a state of being away from the body.

Further, if the wireless terminal has a folder which is opened in a different direction and in opposition to the body, the controller determines if the folder in a closed state is opened in a predetermined direction, for example, upward, and in opposition to the body and the display unit of the wireless terminal is switched into the portrait screen mode, or if the folder in a closed state is opened in a predetermined direction, for example, rightward, and in opposition to the body and the display unit of the wireless terminal is switched into the landscape screen mode.

If it is determined that the wireless terminal has been switched into the portrait screen mode through step 602, the controller detects the switching into the portrait screen mode in step 603. In step 604, the controller logically adds the second area C2 to the lower side of the first area C1 as illustrated in FIG. 5*a*, thereby forming the display buffer of the DC for the screen size in the portrait screen mode.

In step 605, the controller records a corresponding image from the start address value (0, 0) to the last address value (128, 128) of the first area C1 while increasing a column address value from leftward to rightward, and increasing a line address value from upward to downward in the display buffer of the DC formed by logically adding the second area C2 to the lower side of the first area C1. If the corresponding image is completely recorded in the first area C1 in step 605, the controller records the corresponding image from the start address value (0, 128) to the last address value (128, 228) of the second area C2 while increasing the column address value from leftward to rightward and increasing the line address value from upward to downward. In this way, the controller controls the corresponding image, which is to be output to the screen size of the portrait screen mode, to be recorded.

Further, when it is detected that the wireless terminal is switched into the portrait screen mode through rotation of the folder of the wireless terminal far away from the body or that the folder in a closed state is opened upward for the switching into the portrait screen mode, the controller performs the corresponding image recording process through steps 604 and 605. Accordingly, it is possible to reduce consumption of time required for new updates to the screen size of the portrait screen mode.

However, if it is determined that the wireless terminal has been switched into the landscape screen mode through step 602, the controller detects the switching into the landscape screen mode in step 606. In step 607, the controller logically adds the second area C2 to the right side of the first area C1 as illustrated in FIG. 5*b*, thereby forming the display buffer of the DC for the screen size in the landscape screen mode.

In step 608, the controller records a corresponding image in the second area C2 if a column address value increasing from leftward to rightward exceeds an address value (128, Y) in the display buffer of the DC formed by logically adding the second area C2 to the right side of the first area C1. Further, if the column address value exceeds an address value (228, Y), the controller records the corresponding image from the start address value (0, 0) of the first area Cl to the last address value (228, 128) of the second area C2 while increasing the line address value from upward to downward.

Hereinafter, the corresponding image recording process performed in step 608 will be described in more detail. If the column address value increasing from leftward to rightward exceeds an address value (128, Y), the controller records the corresponding image in the second area C2 logically added to the right side of the first area C1. If the column address value exceeds an address value (228, Y), the controller records the corresponding image to be output to the screen size in the landscape screen mode while increasing the line address value from upward to downward. Herein, a direction in which the corresponding image is recorded in the second area C2 is computed and recorded in a direction actually recorded in a physical memory.

In FIG. 5*b*, the second area (C2-1) represents a direction in which the corresponding image recorded in the second area C2 is actually recorded in the physical memory. In the second area C2 logically added to the first area C1, the controller records the corresponding image while increasing the column address value from leftward to rightward and increasing the line address value from upward to downward. However, in the actual second area (C2-1) of the physical memory, the controller records the corresponding image while increasing the line address value from upward to downward and increasing the column address value from leftward to rightward.

A direction in which the corresponding image is actually recorded in the second area (C2-1) of the physical memory may be altered according to methods for logically adding the second area (C2-1) to the second area C2.

(a) if an address value (0, 129) of the second area (C2-1) is located at an address value (129, 0) of the logically added second area (C2), the controller increases the line address value from upward to downward and increases the column address value from leftward to rightward in the actual second area (C2-1) of the physical memory.

(b) if an address value (0, 228) of the second area (C2-1) is located at an address value (129, 0) of the logically added second area (C2), the controller records the corresponding image while decreasing the line address value from downward to upward and increasing the column address value from leftward to rightward starting from an address value (Y, 228) in the actual second area (C2-1) of the physical memory.

(c) if an address value (128, 129) of the second area (C2-1) is located at an address value (129, 0) of the logically added second area (C2), the controller increases the line address value from upward to downward and decreases the column address value from rightward to leftward in the actual second area (C2-1) of the physical memory.

(d) if an address value (128, 228) of the second area (C2-1) is located at an address value (129, 0) of the logically added second area (C2), the controller records the corresponding image while decreasing the line address value from downward to upward and decreasing the column address value from rightward to leftward starting from an address value (Y, 228) in the actual second area (C2-1) of the physical memory.

Equation $$\text{second logic area } (x0, y1) = \text{second area of actual memory } (y1, x0) \quad (a)$$

$$\text{second logic area } (x0, y1) = \text{second area of actual memory } (y1, \text{max-}x0) \quad (b)$$

$$\text{second logic area } (x0, y1) = \text{second area of actual memory } (\text{max-}y1, x0) \quad (c)$$

$$\text{second logic area } (x0, y1) = \text{second area of actual memory } (\text{max-}y1, \text{max-}x\,0) \quad (d)$$

The above equation represents an equation used for computing location of pixels, which are actually recorded in the physical memory, which corresponds to the pixel location of the corresponding image recorded in the logically added second area (C2).

Further, when it is detected that the wireless terminal is switched into the landscape screen mode through rotation of the folder in state of being away from the body of the wireless terminal or that the folder in a closed state is opened rightward for the switching into the landscape screen mode, the controller performs the corresponding image recording process through steps 607 and 608. Accordingly, it is possible to reduce consumption of time required for new updates to the screen size of the landscape screen mode.

Either the corresponding image recorded in the display buffer of the DC formed by logically adding the second area C2 to the lower side of the first area C1 in step 605 in order to be output to the screen size in the portrait screen mode, or the corresponding image recorded in the display buffer of the DC formed by logically adding the second area C2 to the right side of the first area C1 in step 608 in order to be output to the screen size in the landscape screen mode is stored in the memory of a display unit driver and output to the screen of a corresponding screen mode of the display unit, in step 609.

As described above, certain exemplary embodiments of the present invention provide a method for recording and outputting images through the display buffer of one DC in a wireless terminal, so that it is possible to output the images while maintaining continuity when a screen mode is switched. Further, screen size information is stored without creating complicated codes for managing the display buffer of the DC twice, so that a necessary memory can be reduced 50% at maximum.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. A method for displaying an image in a wireless terminal comprising at least two screen modes, the method comprising:

forming a display buffer in one Device Context (DC) for recording a corresponding image to be displayed according to screen sizes in at least two screen modes;

recording the corresponding image to be displayed according to a screen size of a corresponding screen mode of said at least two screen modes through the display buffer in the DC after the step of forming a display buffer and without altering the length of the corresponding image; and outputting the corresponding image to a screen in the corresponding screen mode.

2. The method as claimed in claim 1, wherein a size of the display buffer comprises all screen sizes in said at least two screen modes.

3. The method as claimed in claim 2, wherein the display buffer comprises an area shared by the screen sizes in said at least two screen modes and corresponding areas for the screen sizes in said at least two screen modes.

4. The method as claimed in claim 1, wherein the display buffer comprises a first area shared by the screen sizes in said at least two screen modes and a second area logically added to a location of the first area, said second area corresponding to the screen size in the corresponding screen mode of said at least two screen modes.

5. The method as claimed in claim 4, wherein the second area is logically added to at least one of an upper side, a lower side, a left side and a right side of the first area.

6. The method as claimed in claim 4, wherein the second area comprises a plurality of areas.

7. A method for displaying an image in a wireless terminal comprising a first and second screen modes, the method comprising:

forming a display buffer in one Device Context (DC) for recording a corresponding image to be displayed according to screen sizes in the first and the second screen modes;

determining if the wireless terminal is in at least one of the first screen mode and the second screen mode;

when the wireless terminal is in the first screen mode, recording a corresponding image in a first area shared by the screen sizes in the first and the second screen modes, and a third area for the screen size in the first screen mode in the display buffer in the DC, and outputting the corresponding image to a screen in the first screen mode; and when the wireless terminal is in the second screen mode, recording a corresponding image in the first area shared by the screen sizes in the first and the second screen modes, and a second area for the screen size in the second screen mode in the display buffer in the DC without altering the length of the corresponding image, and outputting the corresponding image to a screen in the second screen mode.

8. The method as claimed in claim 7, wherein the display buffer comprises the first area, which are shared by the screen sizes in the first and the second screen modes, the second area for the screen size in the second screen mode, and the third area for the screen size in the first screen mode.

9. The method as claimed in claim 7, wherein the first and the second screen modes are determined according to whether a folder of the wireless terminal comprises at least one of opened, closed and rotated configurations.

10. The method as claimed in claim 7, wherein, when the first screen mode comprises a portrait screen mode, recording the corresponding image in the first area shared by the screen sizes in the first and the second screen modes, and the third area for the screen size in the first screen mode located at a lower side of the first area, in the display buffer, and outputting the corresponding image to the screen in the first screen mode.

11. The method as claimed in claim 7, wherein, when the second screen mode comprises a landscape screen mode, recording the corresponding image in the first area shared by the screen sizes in the first and the second screen modes and the second area for the screen size in the second screen mode located at a right side of the first area, in the display buffer, and outputting the corresponding image to the screen in the second screen mode.

12. A method for displaying an image in a wireless terminal comprising a first and second screen modes, the method comprising:

forming a display buffer in one Device Context (DC) for recording a corresponding image to be displayed according to screen sizes in the first and the second screen modes;

determining if the wireless terminal is in at least one of the first screen mode and the second screen mode;

when the wireless terminal is in the first screen mode, recording a corresponding image in a first area shared by the screen sizes in the first and the second screen modes, and a second area logically added to a location of the first area in order to correspond to the screen size in the second screen mode, in the display buffer in the DC, and outputting the corresponding image to a screen in the first screen mode; and when the wireless terminal is in the second screen mode, recording a corresponding image in both the first area shared by the screen sizes in the first and the second screen modes, and the second area logically added to the location of the first area in order to correspond to the screen size in the second screen mode, in the display buffer in the DC without altering the length of the corresponding image, and outputting the corresponding image to a screen in the second screen mode.

13. The method as claimed in claim 12, wherein the display buffer comprises the first area shared by the screen sizes in the first and the second screen modes, and the second area logically added to the location of the first area in order to correspond to a screen size in a corresponding screen mode.

14. The method as claimed in claim 13, wherein the second area comprises a plurality of areas.

15. The method as claimed in claim 13, wherein the second area comprises a single area.

16. The method as claimed in claim 12, wherein the first and the second screen modes are determined according to whether a folder of the wireless terminal comprises at least one of opened, closed and rotated configurations.

17. The method as claimed in claim 12, wherein the outputting of the corresponding image to the screen in the first screen mode comprises:

when the first screen mode is a portrait screen mode, logically adding the second area to a lower side of the first area in the display buffer, which is shared by the screen sizes in the first and the second screen modes, thereby forming the display buffer;

recording the corresponding image in the first area and the second area; and outputting the corresponding image to the screen in the first screen mode.

18. The method as claimed in claim 12, wherein the outputting of the corresponding image to the screen in the second screen mode comprises:

when the second screen mode is a landscape screen mode, logically adding the second area to a right side of the first area in the display buffer, which is shared by the screen sizes in the first and the second screen modes, thereby forming the display buffer;

recording the corresponding image in the first area and the second area; and outputting the corresponding image to the screen in the second screen mode.

19. The method as claimed in claim 18, wherein the corresponding image recorded in the second area is recorded in a direction in which the corresponding image is recorded in a physical memory.

20. The method as claimed in claim 1, wherein the wireless terminal controls the screen according to landscape mode or portrait mode.

* * * * *